US007113610B1

(12) United States Patent
Chrysanthakopoulos

(10) Patent No.: US 7,113,610 B1
(45) Date of Patent: Sep. 26, 2006

(54) VIRTUAL SOUND SOURCE POSITIONING

(75) Inventor: Georgios Chrysanthakopoulos, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 696 days.

(21) Appl. No.: 10/241,766

(22) Filed: Sep. 10, 2002

(51) Int. Cl.
*H04R 5/02* (2006.01)

(52) U.S. Cl. ..... 381/309; 381/310

(58) Field of Classification Search ..... 381/17, 381/18, 310, 309; 463/35
See application file for complete search history.

(56) References Cited

U.S. PATENT DOCUMENTS

| | | | | |
|---|---|---|---|---|
| 4,731,848 | A | 3/1988 | Kendall et al. | 381/63 |
| 5,436,975 | A | 7/1995 | Lowe et al. | 381/17 |
| 5,632,005 | A * | 5/1997 | Davis et al. | 704/504 |
| 5,943,427 | A * | 8/1999 | Massie et al. | 381/17 |
| 5,991,385 | A | 11/1999 | Dunn et al. | 379/202 |
| 5,993,318 | A | 11/1999 | Kousaki | 463/35 |
| 6,553,121 | B1 * | 4/2003 | Matsuo et al. | 381/17 |
| 2002/0150257 | A1 * | 10/2002 | Wilcock et al. | 381/17 |

OTHER PUBLICATIONS

Cheng, Corey I. and Gregory H. Wakefield. 1999. Introduction to Head-Related Transfer Functions (HRTF'S): Representations of HRTF's in Time, Frequency, and Space. Paper presented at 107th Audio Engineering Society Convention, Sep. 24-27, Jacob K. Javits Center, NY, NY.

Chowning, John M. 1971. "The Simulation of Moving Sound Sources." First Published *J. Audio Eng. Soc.* 19, 2-6.

* cited by examiner

*Primary Examiner*—Vivian Chin
*Assistant Examiner*—Corey Chau
(74) *Attorney, Agent, or Firm*—Ronald M. Anderson

(57) ABSTRACT

Indicating a spatial location of a virtual sound source by determining an output for each of one or more physical speakers as a function of an orientation of corresponding virtual speakers that track the position and orientation of a virtual listener relative to the virtual sound source in a virtual environment or game simulation. A vector distance between the virtual sound source and each virtual speaker is used to determine a volume level for each corresponding physical speaker. Each virtual speaker is specified at a fixed location on a unit sphere centered on the virtual listener, and the virtual sound source is normalized to a virtual position on the unit sphere. All computations are performed in Cartesian coordinates. Preferably, each virtual speaker vector distance is used in a nonlinear function to compute a volume attenuation factor for the corresponding physical speaker output.

41 Claims, 6 Drawing Sheets

VIRTUAL SOUND SOURCE POSITIONING

FIELD OF THE INVENTION

The present invention generally relates to providing cues as to the spatial location of a virtual signal source in a simulated environment; and more specifically, pertains to determining an output for one or more physical output devices to simulate a perception at a virtual object, as a function of a position and an orientation of the virtual object and as function of a position of virtual output devices relative to the virtual signal source.

BACKGROUND OF THE INVENTION

When experiencing a virtual environment graphically and audibly, a participant is often represented in the virtual environment by a virtual object. A virtual sound source produces sound that should vary realistically as movement between the virtual sound source and the virtual object occurs. The person participating in the virtual environment should ideally hear sound corresponding to the sound that would be heard by the virtual object representing the person in the virtual environment. In attempting to achieve this goal in the prior art, one or more signals associated with a simulated signal source are output through one or more stationary output devices.

Sound associated with a simulated sound source in a computer simulation is played through one or more stationary speakers. Because the speakers are stationary relative to the participant in the virtual environment, they typically do not accurately reflect a location of the simulated sound source, particularly when there is relative movement between the virtual sound source and the virtual object representing the participant. Accurate spatial location of the simulated sound source is a function of direction, distance, and velocity of the simulated sound source relative to a listener represented by the virtual object. Independent sound signals from sufficiently separated fixed speakers around the listener can provide some coarse spatial location, depending on a listener's location relative to each of the speakers. However, for more accurate spatial location, other audio cues must be employed to indicate position and motion of the simulated sound source. One such audio cue is the result of the difference in the times at which sounds from the speakers arrive at a listener's left and right ears, which provides an indication of the direction of the sound source relative to the listener. This characteristic is sometimes referred to as an inter-aural time difference (ITD). An example of an ITD system is disclosed by Massie et al. (U.S. Pat. No. 5,943,427). Another audio cue relates to the relative amplitudes of sound reaching the listener from different sources, which can be varied with a gain control (i.e., a volume control). The approach of a sound source toward the listener can be indicated by controlling the gain (or attenuation) to provide an increasing volume from a speaker. Angular direction to a source relative to the listener can also be indicated by producing a greater volume from one speaker than from another speaker, and changes in the angular direction can be indicated by changing these relative volumes. This amplitude variation is sometimes referred to as inter-aural intensity difference (IID).

Often, however, these simple binaural cues are inaccurate, because the precise location of the listener is not known. For example, the listener may be very close to a speaker that produces a low volume, such that the volume from each of a plurality of surrounding speakers is perceived as substantially equivalent by the listener. Similarly, the listener's head may be orientated such that the sounds produced by each speaker may reach both ears of the listener at about the same time. These binaural cues also become unreliable when attempting to estimate a sound's location in three-dimensional (3D) free space rather than in a two-dimensional (2D) plane, because the same IDT and/or IID results at an infinite number of points along curves of equal distance from the listener's head. For example, a series of points that are equal distance from the listener's head may form a circle. The IDT and/or IID at any point on this circle is the same. Thus, the listener cannot distinguish the true location of a simulated sound source that emanates from any one of the points on the circle. A series of these curves expand away from the listener, resulting in a conical shape. For this reason, the spatial location ambiguity is sometimes called "a cone of confusion."

To compensate for these inadequacies, prior art systems have been developed that alternatively or additionally estimate acoustic filtering corresponding to the sound wave diffraction by the listener's head, torso, and outer ear (pinna). It is believed that the human ear may obtain spatial cues from this natural filtering of sound frequencies. Thus, these practitioners estimate and apply filtering functions to the simulated sound in an attempt to provide frequency-based spatial cues to the listener. Such functions are referred to as Head-Related Transfer Functions (HRTFs). Specifically, the HRTF is an individual listener's left or right ear far-field frequency response, as measured from a point in 3D space to a point in the ear canal of the listener. Thus, the HRTF is unique to each individual. Consequently, an HRTF is difficult to generalize for all listeners, and is complex to apply. Often, dedicated real time digital signal processing (DSP) hardware is needed to implement even simple spatialization algorithms. Also, implementing an HRTF requires storing, accessing, and processing a substantial amount of data. Such tasks often lead to a computational bottleneck for spatialization processing, which may be unacceptable in games and virtual environment programs, particularly, because it is difficult to implement HRTFs with low-cost computing devices. Moreover, HRTFs do not fully address certain of the spatialization problems. For example, HRTFs often cause sounds that originate in front of a listener to actually sound like they originate behind the listener. Also, for sounds near a median plane between the listener's two ears, HRTFs are known to cause a listener to perceive that the sound emanates from inside the head instead of outside the head of the listener.

In short, there is no universally acceptable approach to guarantee accurate spatial localization with fixed speakers, even using high-cost, complex calculations. Nevertheless, it would be preferable to devise an alternative that provides more accurate spatial localization than basic IDT and/or IID binaural techniques, yet is more computationally efficient and cost effective than HRTFs. To achieve greater accuracy than basic IDT and/or IID binaural techniques, it is further preferable to improve computational efficiency to enable computational solutions to the problem to be applied. Typically, binaural techniques use polar or spherical coordinates in trigonometric calculations required to control the sound produced by different speakers to better simulate what a listener would expect to hear at the location of virtual object in a virtual environment in response to sound produced by a virtual sound source. Trigonometric calculations usually require more computational resources than those involving Cartesian coordinates. Thus, it is preferable to use Cartesian coordinates in the proposed alternative.

SUMMARY OF THE INVENTION

The present invention provides a method and system for determining an output signal to drive one or more physical sound sources, such as speakers, to simulate the spatial perception of a virtual sound source by a virtual listener in a virtual environment, based on the orientation of the virtual listener relative to the virtual sound source. The invention uses vectors between the virtual sound source and the virtual listener and between the virtual sound source and one or more virtual speakers that remained fixed relative to the location and orientation of the virtual listener in the virtual environment. The virtual speakers track any change in the location and/or orientation of the virtual listener relative to the virtual sound source, so that updated vectors reflect current and changing spatial positions of the virtual sound source. Each vector is used with a linear or nonlinear function to determine the amplitude of the output signal to drive each physical speaker. The output signal amplitude translates into the volume at each physical speaker, so that a real listener can more accurately detect the spatial location of the virtual sound source, as if the real listener were in the place of the virtual listener in the virtual environment. A changing volume at each physical speaker also indicates motion of the virtual listener or the virtual sound source. Multiple virtual speaker vectors can also be used in combination to determine an output signal to drive fewer physical speakers, such as vector for four virtual speakers around the virtual listener to generate an output signal at each of two physical speakers.

The virtual speakers can be located anywhere around the virtual listener. Preferably, however, the virtual speakers are located on a unit sphere that remains centered on the virtual listener as the virtual listener changes position and/or orientation in the virtual environment. The virtual speakers may be located at predefined locations on the unit sphere or selectively located on the unit sphere via a user interface. The virtual sound source vector is also preferably normalized to the unit sphere to simplify computations. Cartesian coordinates are also used to simplify computations.

Another aspect of the invention is a method and system for attenuating the output signal to drive each physical speaker. A further aspect of the invention is a machine readable medium storing machine instructions for performing the invention.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

Figure 5:
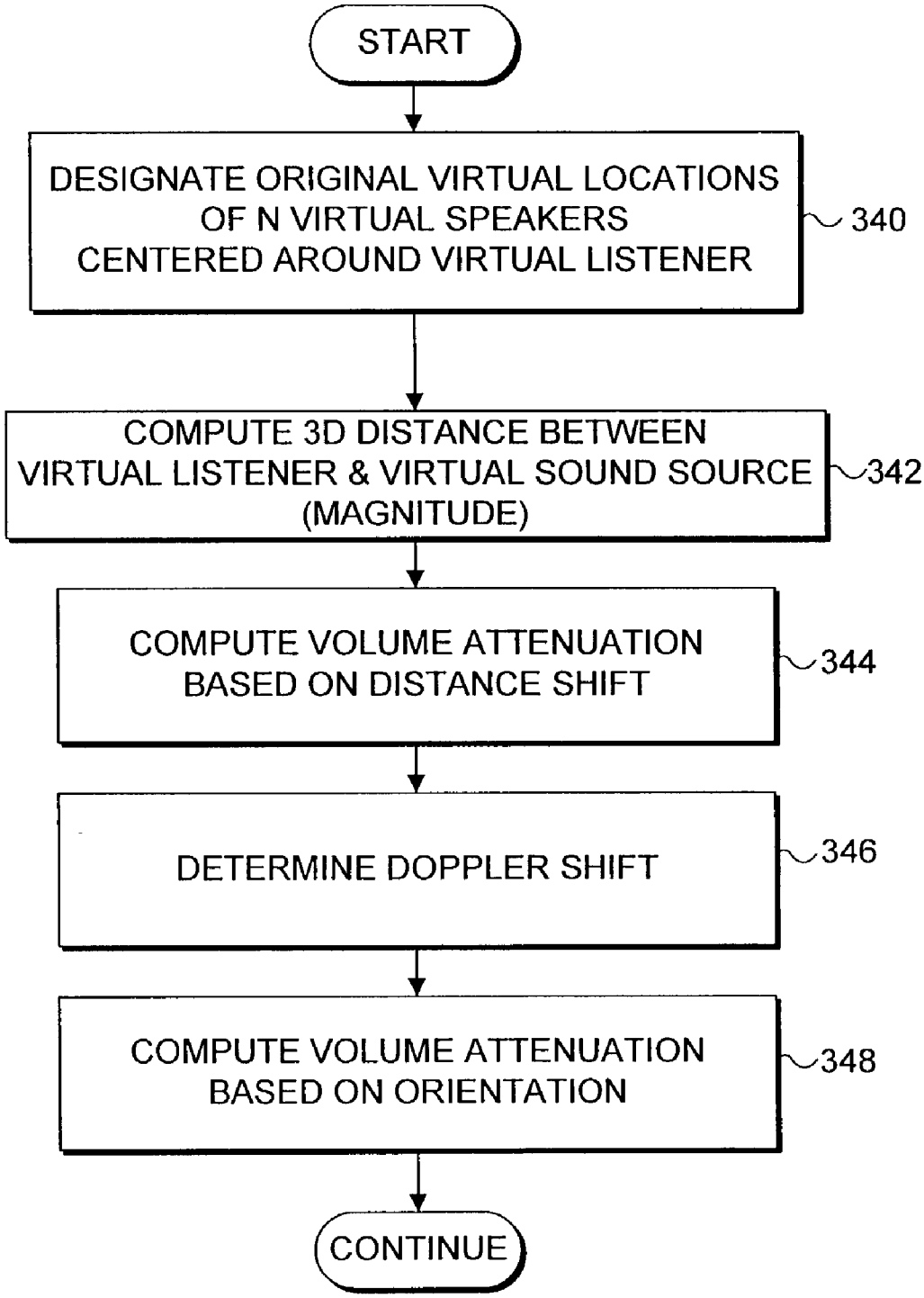
Figure 6:
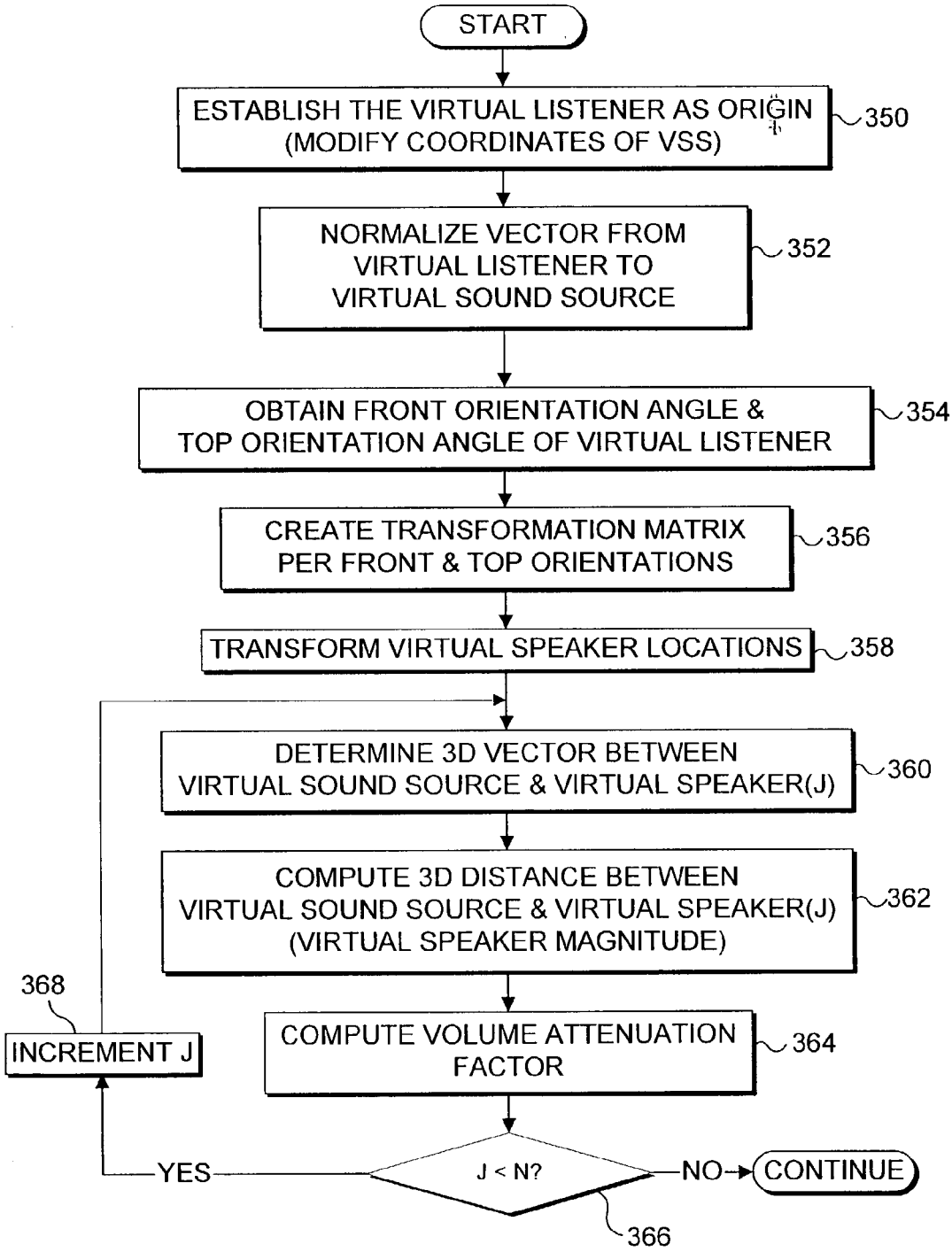

FIG. 5 is a flow chart illustrating logical steps implemented to determine an audio volume for each physical speaker as a function of the position and orientation of the virtual listener and virtual speakers relative to the virtual sound source; and FIG. 6 is a flow chart illustrating logical steps implemented for computing a volume attenuation for one or more physical speakers, based on an orientation of the virtual listener and corresponding virtual speakers relative to the virtual sound source.

DESCRIPTION OF THE PREFERRED EMBODIMENT

A preferred embodiment of the present invention is described below in regard to an exemplary use in providing audio for an electronic gaming system that is designed to execute gaming software distributed on a portable, removable medium. Those skilled in the art will recognize that the present invention may also be implemented in conjunction with a set-top box, an arcade game, a hand-held device, an attached high fidelity system or associated computer speaker system, and other related systems. It should also be apparent that the present invention may be practiced on a single machine, such as a single personal computer, or practiced in a network environment, with multiple consoles or computing devices interconnected with one or more server computers.

Exemplary Operating Environment

Figure 1:
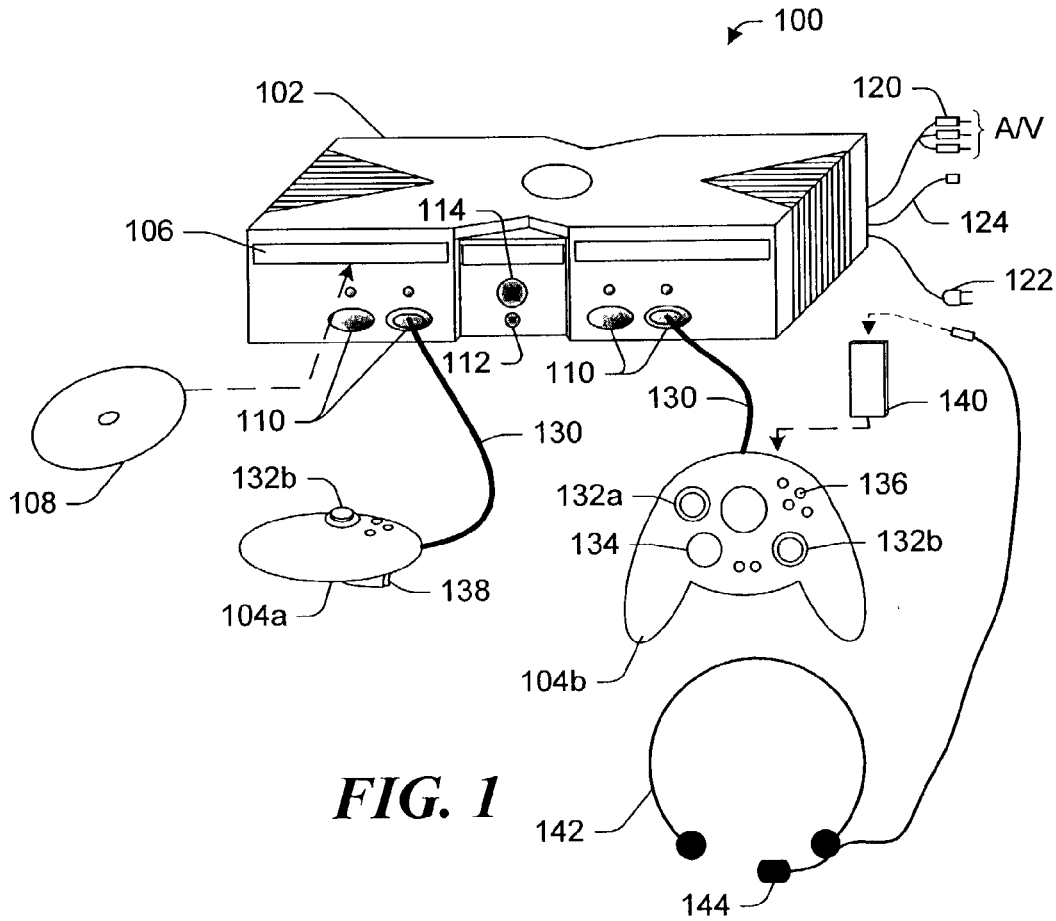
FIG. 1 illustrates an exemplary electronic gaming system that includes a game console and support for up to four user input devices.

As shown in FIG. 1, an exemplary electronic gaming system 100 that is suitable for practicing the present invention includes a game console 102 and support for up to four user input devices, such as controllers 104*a* and 104*b*. Game console 102 is equipped with an internal hard disk drive (not shown in this Figure) and a portable media drive 106 that supports various forms of portable optical storage media, as represented by an optical storage disc 108. Examples of suitable portable storage media include DVD discs and CD-ROM discs. In this gaming system, game programs are preferably distributed for use with the game console on DVD discs, but it is also contemplated that other storage media might instead be used on this or other types of systems that employ the present invention.

On a front face of game console 102 are four slots 110 for connection to supported controllers, although the number and arrangement of slots may be modified. A power button 112, and an eject button 114 are also positioned on the front face of game console 102. Power button 112 controls application of electrical power to the game console, and eject button 114 alternately opens and closes a tray (not shown) of portable media drive 106 to enable insertion and extraction of storage disc 108, so that the digital data on it can be read for use by the game console.

Game console 102 connects to a television or other display monitor or screen (not shown) via audio/visual (A/V) interface cables 120. A power cable plug 122 conveys electrical power to the game console when connected to a conventional alternating current line source (not shown). Game console 102 includes an Ethernet data connector 124 to transfer and receive data over a network (e.g., through a connection to a hub or a switch—not shown), or over the Internet, for example, through a connection to an xDSL interface, a cable modem, or other broadband interface (not shown). Other types of game consoles that implement the present invention may be coupled together or to a remote server, by communicating using a conventional telephone modem.

Each controller 104*a* and 104*b* is coupled to game console 102 via a lead (or alternatively through a wireless interface).

In the illustrated implementation, the controllers are universal serial bus (USB) compatible and are connected to game console 102 via USB cables 130. Game console 102 may be equipped with any of a wide variety of user devices for interacting with and controlling the game software. As illustrated in FIG. 1, each controller 104*a* and 104*b* is equipped with two thumbsticks 132*a* and 132*b*, a D-pad 134, buttons 136, and two triggers 138. These controllers are merely representative, and other gaming input and control devices may be substituted for or added to those shown in FIG. 1 for use with game console 102.

A removable function unit 140 can optionally be inserted into controller 104 to provide additional features and functions. For example, a portable memory unit (MU) enables users to store game parameters and port them for play on other game consoles, by inserting the portable MU into a controller connected to the other game console. Another removable functional unit comprises a voice communication unit that enables a user to verbally communicate with other users locally and/or over a network. Connected to the voice communication unit is a headset 142, which includes a boom microphone 144. In the described implementation, each controller is configured to accommodate two removable function units, although more or fewer than two removable function units or modules may instead be employed.

Gaming system 100 is capable of playing, for example, games, music, and videos. It is contemplated that other functions can be implemented using digital data stored on the hard disk drive or read from optical storage disc 108 in drive 106, or using digital data obtained from an online source, or from MU 140. For example, gaming system 100 is potentially capable of playing:

- Game titles stored on CD and DVD discs, on the hard disk drive, or downloaded from an online source;
- Digital music stored on a CD in portable media drive 106, in a file on the hard disk drive (e.g., Windows Media Audio™ (WMA) format), or derived from online streaming sources on the Internet or other network; and
- Digital A/V data stored on a DVD disc in portable media drive 106, or in a file on the hard disk drive (e.g., in an Active Streaming Format), or from online streaming sources on the Internet or other network.

Figure 2:
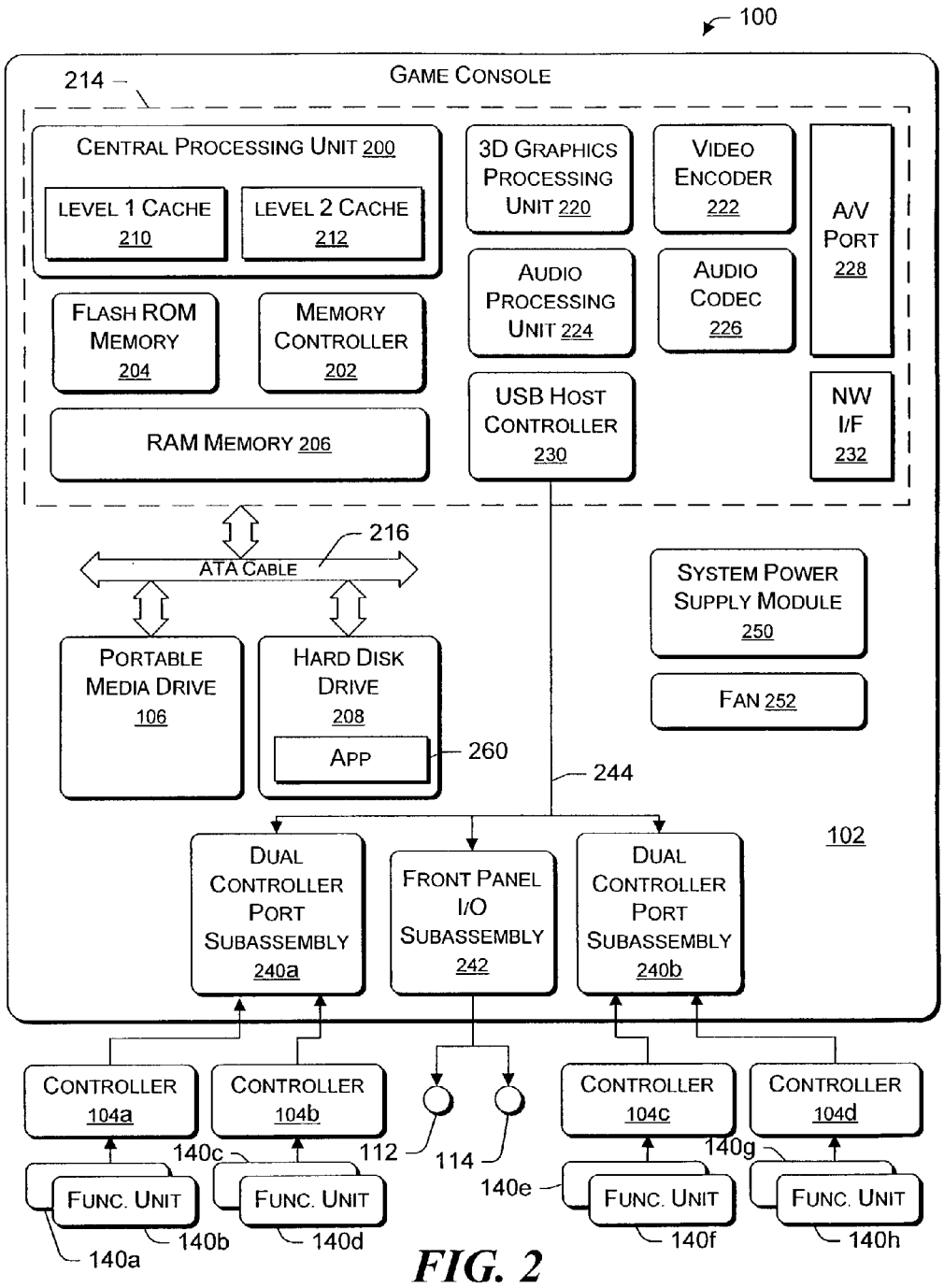
FIG. 2 is a functional block diagram showing components of the gaming system in greater detail.

FIG. 2 shows functional components of gaming system 100 in greater detail. Game console 102 includes a central processing unit (CPU) 200, and a memory controller 202 that facilitate processor access to a read-only memory (ROM) 204, a random access memory (RAM) 206, a hard disk drive 208, and portable media drive 106. CPU 200 is equipped with a level 1 cache 210 and a level 2 cache 212 to temporarily store data so as to reduce the number of memory access cycles required, thereby improving processing speed and throughput. CPU 200, memory controller 202, and various memory devices are interconnected via one or more buses, including serial and parallel buses, a memory bus, a peripheral bus, and a processor or local bus using any of a variety of bus architectures. By way of example, such architectures can include an Industry Standard Architecture (ISA) bus, a micro channel architecture (MCA) bus, an enhanced ISA (EISA) bus, a Video Electronics Standards Association (VESA) local bus, and a peripheral component interconnect (PCI) bus.

As an example of one suitable implementation, CPU 200, memory controller 202, ROM 204, and RAM 206 are integrated onto a common module 214. In this implementation, ROM 204 is configured as a flash ROM that is connected to memory controller 202 via a PCI bus and a ROM bus (neither of which are shown). RAM 206 is configured as multiple double data rate synchronous dynamic RAMs (DDR SDRAMs) that are independently controlled by memory controller 202 via separate buses (not shown). Hard disk drive 208 and portable media drive 106 are connected to the memory controller via the PCI bus and an advanced technology attachment (ATA) bus 216.

A 3D graphics processing unit (GPU) 220 and a video encoder 222 form a video processing pipeline for high-speed and high-resolution graphics processing. Data are carried from graphics processing unit 220 to video encoder 222 via a digital video bus (not shown). An audio processing unit 224 and an audio encoder/decoder (CODEC) 226 form a corresponding audio processing pipeline for high fidelity and stereo audio data processing. Audio data are carried between audio processing unit 224 and audio CODEC 226 via a communication link (not shown). The video and audio processing pipelines output data to an A/V port 228 for transmission to the television or other display monitor. In the illustrated implementation, video and audio processing components 220–228 are mounted on module 214.

Also implemented by module 214 are a USB host controller 230 and a network interface 232. USB host controller 230 is coupled to CPU 200 and memory controller 202 via a bus (e.g., the PCI bus), and serves as a host for peripheral controllers 104*a*–104*d*. Network interface 232 provides access to a network (e.g., the Internet, home network, etc.) and may be any of a wide variety of various wire or wireless interface components, including an Ethernet card, a telephone modem interface, a Bluetooth module, a cable modem interface, an xDSL interface, and the like.

Game console 102 has two dual controller support subassemblies 240*a* and 240*b*, with each subassembly supporting two game controllers 104*a*–104*d*. A front panel input/output (I/O) subassembly 242 supports the functionality of power button 112 and eject button 114, as well as any light-emitting diodes (LEDs) or other indicators exposed on the outer surface of the game console. Subassemblies 240*a*, 240*b*, and 242 are coupled to module 214 via one or more cable assemblies 244.

Eight function units 140*a*–140*h* are illustrated as being connectable to four controllers 104*a*–104*d*, i.e., two function units for each controller. Each function unit 140 offers additional functionality or storage on which games, game parameters, and other data may be stored. When an MU is inserted into a controller, the MU can be accessed by memory controller 202.

A system power supply module 250 provides power to the components 10*f* gaming system 100. A fan 252 cools the components and circuitry within game console 102.

To implement the present invention, a game software application 260 comprising machine instructions stored on a DVD or other storage media (or downloaded over the network) is loaded into RAM 206 and/or caches 210, 212 for execution by CPU 200. Portions of software application 260 may be loaded into RAM only when needed, or all of the software application (depending on its size) may be loaded into RAM 206. Software application 260 and the relevant functions that it performs to implement the present invention are described below in greater detail.

Gaming system 100 may be operated as a stand-alone system by simply connecting the system to a television or other display monitor. In this standalone mode, gaming system 100 enables one or more users to play games, watch movies, or listen to music. However, with connectivity to the Internet or other network, which is made available through network interface 232, gaming system 100 may be further operated as a component of a larger network gaming community, to enable online multiplayer interaction in games that are played over the Internet or other network with players using other gaming systems. Gaming system 100 can also be coupled in peer-to-peer communication with another gaming system using the network interface and appropriate cable.

Network System

Figure 3:
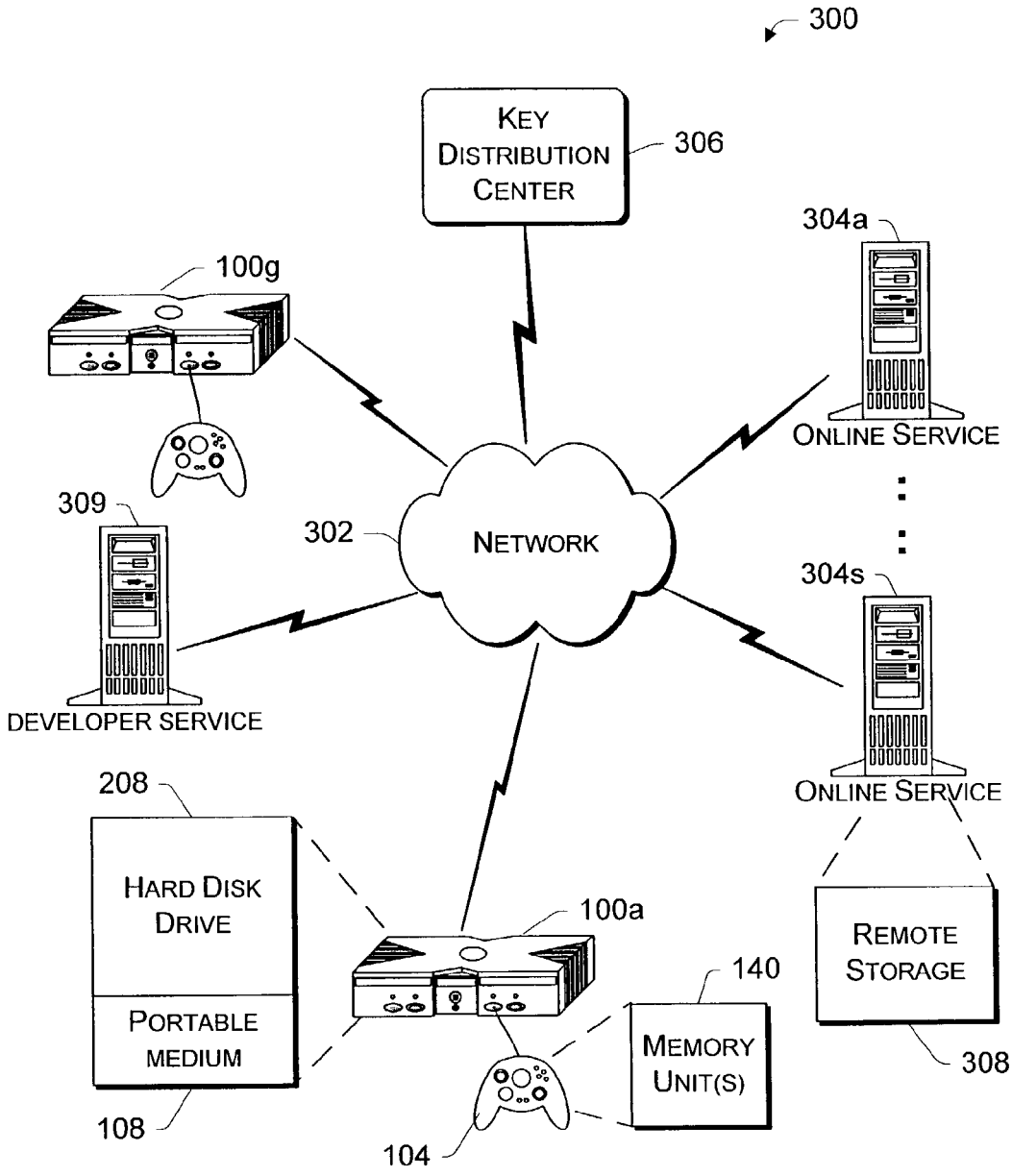
FIG. 3 shows an exemplary network gaming environment that interconnects multiple gaming systems via a network.

FIG. 3 shows an exemplary network gaming environment 300 that interconnects multiple gaming systems 100*a*, . . . 100*n* via a network 302. Network 302 represents any of a wide variety of data communications networks and may include public portions (e.g., the Internet), as well as private portions (e.g., a residential or commercial local area network (LAN)). Network 302 may be implemented using any one or more of a wide variety of conventional communication configurations, including both wired and wireless types. Any of a wide variety of communications protocols can be used to communicate data via network 302, including both public and proprietary protocols. Examples of such protocols include TCP/IP, IPX/SPX, NetBEUI, etc.

In addition to gaming systems 100, one or more online services 304*a*, . . . 304*s* are accessible via network 302 to provide various services for the participants, such as serving and/or hosting online games, serving downloadable music or video files, hosting gaming competitions, serving streaming A/V files, enabling exchange of email or other media communications, and the like. Network gaming environment 300 may further employ a key distribution center 306 that plays a role in authenticating individual players and/or gaming systems 100 for interconnection to one another, as well as to online services 304*a*, . . . 304*s*. Distribution center 306 distributes keys and service tickets to valid participants that may then be used to form game playing groups including multiple players, or to purchase services from online services 304*a*, . . . 304*s*.

Network gaming environment 300 introduces another memory source available to individual gaming systems 100, i.e., online storage. In addition to accessing data on optical storage disc 108, hard disk drive 208, and stored in the MU(s), gaming system 100*a* can also access data files available at remote storage locations via network 302, as exemplified by remote storage 308 at online service 304*s*.

Network gaming environment 300 further includes a developer service 309 with which developers can produce media effects, updated media data, game code, and other services. Such services can be distributed between the online services and the producers of games for the gaming systems, and between other devices within, and outside of Network gaming environment 300.

Exemplary Amplitude Attenuation Process

An exemplary embodiment of the present invention is directed to attenuating audio volume (i.e., amplitude or sound level) for a plurality of physical speakers to simulate the sound that would be heard from a virtual sound source in a virtual environment by a virtual object representing the listener, for use in connection with an electronic game or other type of virtual environment. As indicated above in the Background of the Invention section, the location and orientation of a real listener (e.g., a computer game participant of player) is typically not known to the software. However, in cases such as computer games and virtual simulations, the virtual location and orientation of a virtual point in the virtual environment, e.g., the location of the virtual object representing the person (referred to hereafter as the virtual listener) is often known. Alternatively, a virtual location and orientation may be estimated or assumed. In such cases, it is preferable to use the virtual listener's location and orientation rather than use complex HRTF.

Figure 4:
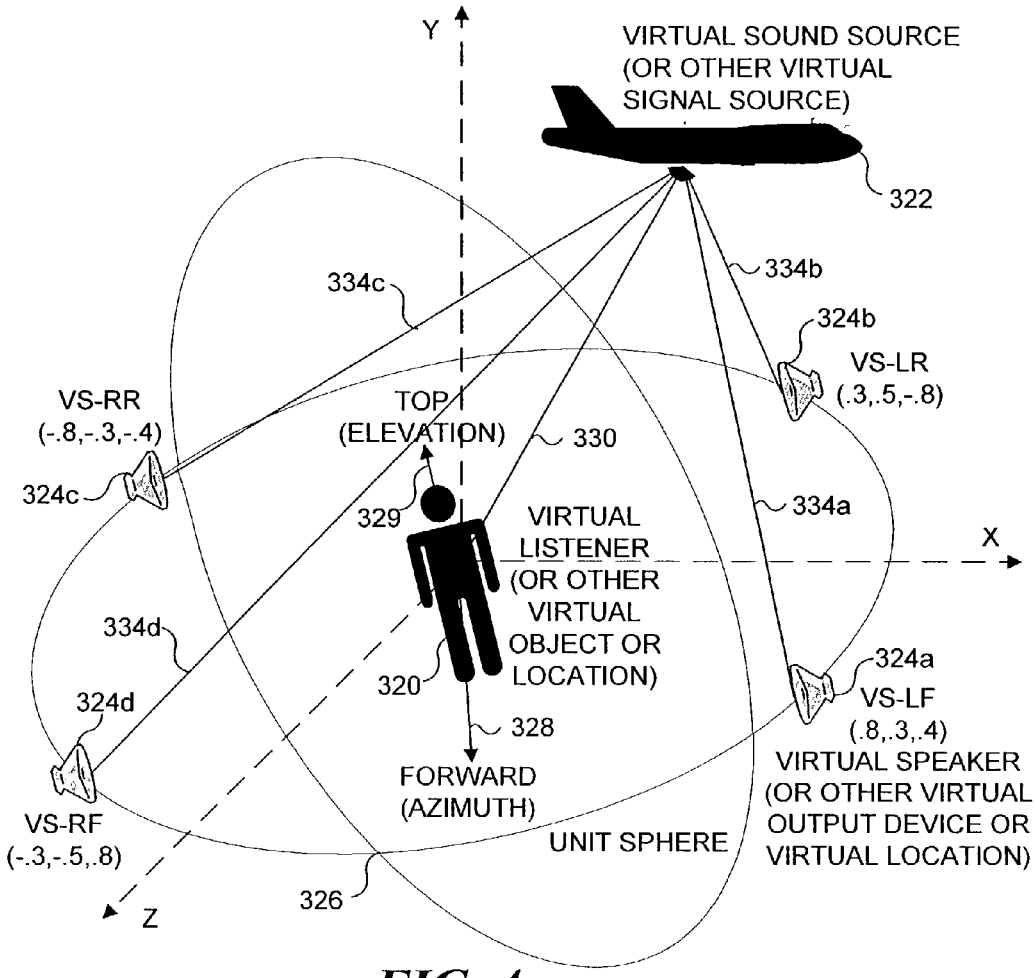
FIG. 4 illustrates a virtual environment and relationships between a virtual listener (sometimes referred to herein as a VL), a virtual sound source (sometimes referred to herein as a VSS), and virtual speakers.

FIG. 4 illustrates a virtual environment and relationships between a virtual listener 320, a virtual sound source 322, and virtual speakers 324*a*–324*d*. Virtual listener 320 represents the simulated character in the computer game. Those skilled in the art will recognize that virtual listener 320 may be any other simulated object or any point whose position can be determined within the virtual environment. The position of virtual listener 320 may change within and relative to the virtual environment, however, for purposes of the present invention, virtual listener 320 is always considered to remain at a local origin of a unit sphere 326. In other words, unit sphere 326 is always centered on virtual listener 320, although unit sphere 326 and virtual listener 320 may move about within the virtual environment, relative to a global origin of the virtual environment. Relative to the local origin of unit sphere 326, virtual listener 320 may be oriented to face in any 3D direction. A forward vector 328 indicates an azimuth of virtual listener 320. Similarly, a top vector 329 indicates an elevation of virtual listener 320 relative to the local origin of unit sphere 326.

Virtual sound source 322 may be located at any position within the virtual environment. However, a virtual sound source vector 330 is normalized to define a corresponding local position of virtual sound source 322 on unit sphere 326. Virtual sound source 322 may be a stationary or moving source of sound, such as another character or other sound-producing object in the virtual environment.

Also located on unit sphere 326 are virtual speakers 324*a*–324*d*. Those skilled in the art will recognize that any number of virtual speakers may be used, and in a preferred form of the present invention, the virtual speakers correspond to an equal or different number of physical speakers. For example, multiple virtual speakers may represent multiple channels that are mixed to a single physical speaker. In any case, virtual speakers 324*a*–324*d* may be selectively positioned anywhere on unit sphere 326. Preferably, the positions of virtual speakers 324*a*–324*d* simulate the positions of the physical speakers, which will typically be spaced apart or positioned around a physical listener, such as a participant in the computer game or virtual simulation. Once the positions of virtual speakers 324*a*–324*d* are determined on unit sphere 326, virtual speakers 324*a*–324*d* preferably remained fixed relative to virtual listener 320 and move with unit sphere 326 as the virtual listener moves relative to the virtual environment. For example, if virtual listener 320 changes orientation by rotating about top vector 329, virtual speakers 324*a*–324*d* are rotated about top vector 329 through an equivalent angle. In any case, virtual speakers 324*a*–324*d* remain fixed relative to unit sphere 326 and move with unit sphere 326 in a manner corresponding to the movement of virtual listener 320.

Associated with each virtual speaker is a virtual speaker vector that extends between the virtual speaker and virtual sound source 322. For example, a virtual speaker vector 334*a* is associated with virtual speaker 324*a*. Virtual speaker vectors 334*a*–334*d* preferably change as virtual sound source 322 moves relative to virtual listener 320 in the virtual environment. Similarly, virtual speaker vectors 334*a*–334*d* change as virtual listener 320 moves or changes orientation relative to virtual sound source 322 in the virtual environment.

FIG. 5 is a flow diagram illustrating the logical steps employed to determine an audio volume for each physical speaker as a function of the position and orientation of the virtual listener and virtual speakers relative to the virtual sound source. At a step 340, a user may selectively (optionally) designate locations of one or more virtual speakers on the unit sphere centered on the virtual listener. Preferably, the user designates the original virtual locations prior to action or play within the virtual environment, but alternatively, might modify the disposition of the virtual speakers on the unit sphere at anytime. However, those skilled in the art will recognize that adjustments to the virtual locations of the virtual speakers may be made at any time. A graphical user interface (GUI) preferably illustrates the unit sphere and enables the user to graphically designate the original locations of the virtual speakers on the unit sphere, and to input the number N of physical speakers to be employed. For simplicity, and computational efficiency, the GUI may limit the original virtual locations of the virtual speakers to a 2D unit circle formed by a generally horizontal plane through the unit sphere. Often, such a limitation reflects the arrangement of the physical speakers, such as a surround sound ("5.1" system) arrangement of physical speakers. However, the original locations of the virtual speakers on the unit sphere can reflect more complex arrangements, such as non-planar positions of physical speakers in a media room, theatre, vehicle, or other physical environment. In any case, if the user does not designate the original virtual locations, an audio module for the computer game will provide default original locations of the virtual speakers. For example, the audio module may position the N (or more) virtual speakers at equally spaced intervals around the virtual listener on the 2D unit circle.

After the original virtual speaker locations are specified and game play begins, the audio module computes a volume attenuation for each virtual speaker during each frame of execution. Note that as used herein, it should be understood that the term "volume attenuation" can instead be a volume gain setting. The key point is that the present invention controls sound level. Each volume attenuation will be applied to the signal representing the sound from the virtual sound source before the signal is routed to drive a specific physical speaker. The process of computing the volume attenuations (or more generally, for computing the sound levels) begins at a step 342, wherein the audio module computes a 3D distance between the virtual listener and the virtual sound source. In other words, the audio module calculates the magnitude of the vector from the virtual listener to the virtual sound source in the simulated environment. Preferably, the audio module uses the following well known formula to calculate the magnitude.

$$\text{magnitude} = \sqrt{(VSS_x - VL_x)^2 + (VSS_y - VL_y)^2 + (VSS_z - VL_z)^2}$$

To simplify and speed processing, all computations are performed in Cartesian coordinates. As indicated above, conversion to and calculations using polar or spherical coordinates are inefficient, because substantially more complex trigonometric computations must be performed than when using Cartesian coordinates.

Once the distance between the virtual listener and the virtual sound source is determined, the audio module computes a volume attenuation, at a step 344, for each physical speaker based on any change in distance (a distance shift attenuation) between the virtual sound source and the virtual listener since a previous execution frame. A number of techniques for determining distance shift attenuation are well known. For example, as described above, the audio module may simply reduce the volume (i.e., increase the attenuation) if the distance between the virtual sound source and the virtual listener has increased since the previous execution frame. Those skilled in the art will recognize that other more complex distance shift methods can be used. At a step 346, the audio module adjusts the volume attenuation, based on the well known Doppler shift. Finally, at a step 348, the audio module performs a unique volume attenuation based on an orientation of the virtual listener and virtual speakers relative to the virtual sound source. Further detail for this last volume attenuation is provided below with regard to FIG. 6.

FIG. 6 is a flow diagram illustrating the logical step employed for computing a volume attenuation for one or more physical speakers, based on an orientation of the virtual listener and virtual speakers relative to the virtual sound source. At a step 350, the audio module establishes the local origin at the Cartesian position of the virtual listener in the virtual environment. Effectively, the audio module determines local coordinates for the virtual sound source relative to the position of the virtual listener in the simulated environment. For example, the audio module may simply subtract each global Cartesian coordinate component of the virtual listener from each global Cartesian coordinate component of the virtual sound source to determine local coordinates of the virtual sound source. This localization process need not be applied to the virtual speaker coordinates, since the virtual speakers remain on the unit sphere. Having localized the virtual sound source, the audio module normalizes the virtual sound source vector between the virtual listener and the virtual sound source. As is well known, this normalization may be achieved by dividing each Cartesian coordinate component of the virtual sound source vector by the magnitude (i.e., the length) of the virtual sound source vector.

The above normalized virtual sound source vector does not depend on the orientation of the virtual listener. However, the position of the virtual speakers, and therefore, each virtual speaker vector does depend on the orientation of the virtual listener relative to the virtual sound source. Consequently, the magnitude of each virtual speaker vector depends on the orientation of the virtual listener relative to the virtual sound source. The audio module uses these virtual speaker vector magnitudes to further adjust the volume attenuation for each physical speaker, thereby providing more accurate spatial location cues to the user without excessively complex computations such as those of HRTFs. Further, because all of the vector calculations are performed in Cartesian coordinates, using virtual speaker vectors to determine the physical speaker attenuation is more computationally efficient than traditional IDT and IID techniques.

To begin determining the virtual speaker vectors, at a step 354, the audio module first obtains a front orientation angle (i.e., an azimuth) and a top orientation angle (i.e., an elevation) of the virtual listener. With this orientation information, the audio module creates a transformation matrix, at a step 356, as is well known to those of ordinary skill. At a step 358, the audio module transforms the virtual speaker locations from their originally designated virtual locations, or from their locations in the previous execution frame, to new positions relative to the virtual listener's orientation. Effectively, the audio module transforms the locations of the virtual speakers on the unit sphere to follow any change in orientation of the virtual listener in the virtual environment.

Having transformed the virtual speaker locations, the audio module loops through the following steps for each of the N virtual speakers. At a step 360, the audio module determines a 3D vector between the current virtual speaker and the virtual sound source. In a manner similar to that described above, the audio module computes a magnitude of the current virtual speaker vector, at a step 362. At a step 364, the audio module computes a volume attenuation factor based on the current virtual speaker vector magnitude. Preferably, the volume attenuation factor is computed by a nonlinear function such as one of those shown below.

$$\text{Volume attenuation factor}=1-e^{-((virtualspeakermagnitude)/Alpha)^2}$$

where Alpha is a scaling value that is empirically determined to provide a sufficiently wide Gaussian function. Preferably, Alpha is approximately 0.20, however, any value can be employed that provides smooth movement of sound from speaker to speaker as the virtual listener or virtual sound source moves, based on sufficient overlap of exponentials representing each speaker.

Alternatively, faster computation can be achieved by using a linear function such as the following dot product.

$$\text{Volume attenuation factor}=(\text{virtual speaker vector})_x\cdot(\text{virtual sound source})_x+(\text{virtual speaker vector})_y\cdot(\text{virtual sound source})_y+(\text{virtual speaker vector})_z\cdot(\text{virtual sound source})_z$$

At a decision step 366, the audio module determines whether a current virtual speaker count J is still less than the total number of virtual speakers N. If a volume attenuation factor must be computed for another virtual speaker, the audio module increments counter J at a step 368. Control then returns to step 360 to process the next virtual speaker. When all virtual speakers have been processed, the volume attenuation factor for each virtual speaker is applied to set the sound level produced by the corresponding physical speaker. As a result, the listener actually hears a sound corresponding to the sound produced by the virtual sound source that closely simulated what the virtual listener would hear within the computer game or other virtual environment. The approach used in the present invention avoids imposing a processing overhead that might slow the play in a computer game or other virtual environment, yet still provides realistic production of the sound that would be heard by the virtual listener.

Although the present invention has been described in connection with the preferred form of practicing it and modifications thereto, those of ordinary skill in the art will understand that many other modifications can be made to the present invention within the scope of the claims that follow. Accordingly, it is not intended that the scope of the invention in any way be limited by the above description, but instead be determined entirely by reference to the claims that follow.

The invention claimed is:

1. A method for determining an output to drive a physical sound source, to simulate an audible experience of a virtual listener exposed to sound from a virtual sound source in a virtual environment, comprising the steps of:

(a) determining a vector from the virtual sound source to the virtual listener in the virtual environment, to create a virtual sound source vector;

(b) determining a vector from the virtual sound source to a virtual speaker position in the virtual environment, to create a virtual speaker position vector, said virtual speaker position being associated with at least one physical sound source, and said virtual speaker position being fixed relative to a location and orientation of the virtual listener such that a location of the virtual speaker position tracks any change in the location of the virtual listener and such that the virtual speaker position tracks any change in the orientation of the virtual listener;

(c) determining the output to drive the physical sound source as a function of the virtual sound source vector and the virtual speaker position vector; and (d) driving the physical sound source with the output, thus enabling the physical sound source to simulate an audible experience of the virtual listener exposed to sound from the virtual sound source in the virtual environment.

2. The method of claim 1, wherein the output comprises a signal representing a sound amplitude.

3. The method of claim 1, wherein the physical sound source comprises a speaker.

4. The method of claim 1, wherein if there is movement between the virtual sound source and the virtual listener, the output is modified to simulate an effect of the movement on an amplitude of the output heard by the virtual listener.

5. The method of claim 1, further comprising the steps of:

(a) determining a second virtual speaker position vector between the virtual sound source and a second virtual speaker; and (b) determining the output to drive the physical sound source as a function of the virtual sound source vector, the second virtual speaker position vector, and the virtual speaker position vector.

6. The method of claim 1, wherein the virtual listener comprises a character in the virtual environment.

7. The method of claim 1, wherein the virtual speaker position comprises a predefined location of a virtual speaker relative to the virtual listener.

8. The method of claim 1, further comprising the steps of:

(a) normalizing the virtual sound source vector relative to a unit sphere in the virtual environment, wherein the unit sphere remains centered on the virtual listener relative to any change in a disposition of the virtual listener in the virtual environment, and wherein the virtual speaker is disposed on the unit sphere; and (b) normalizing the virtual speaker position vector relative to the unit sphere.

9. The method of claim 1, wherein the function is one of a linear and a nonlinear function.

10. The method of claim 2, further comprising at least one of the steps of:

(a) adjusting the output as a function of a distance shift between the virtual sound source and the virtual listener; and (b) adjusting the output as a function of a Doppler effect.

11. The method of claim 1, further comprising the steps of:

(a) determining an orientation of the virtual listener; and (b) changing the virtual speaker position in the virtual environment as a function of a change in the orientation of the virtual listener in the virtual environment.

12. The method of claim 1, further comprising the step of applying a transformation to the virtual speaker position in relation to a change in one of the position and the orientation of the virtual listener in the virtual environment.

13. The method of claim 1, further comprising the steps of:

(a) determining a second virtual speaker position vector from the virtual sound source to a second virtual speaker position in the virtual environment, said second virtual speaker position being associated with a second physical sound source, and said second virtual speaker position being fixed relative to the location and orientation of the virtual listener such that a location of the second virtual speaker position tracks any change in the location and the orientation of the virtual listener; and (b) determining a second output to drive the second physical sound source as a function of the virtual sound source vector and the second virtual speaker position vector.

14. The method of claim 1, further comprising the steps of:

(a) determining a plurality of additional virtual speaker position vectors from the virtual sound source to each of a plurality of additional virtual speaker positions in the virtual environment, each of said additional virtual speaker positions being associated with a corresponding different additional physical sound source, and said plurality of additional virtual speaker positions being fixed relative to the location and orientation of the virtual listener such that locations for each of the plurality of additional virtual speaker positions track any change in the location and the orientation of the virtual listener; and (b) determining the output to drive each additional physical sound source as a function of the virtual sound source vector, the virtual speaker position vector, and a corresponding one of the plurality of additional virtual speaker position vectors.

15. The method of claim 1, wherein the steps comprise machine readable instructions stored on a machine readable medium.

16. A system for determining an output to drive a physical sound source, to simulate an audible experience of a virtual listener exposed to sound from a virtual sound source in a virtual environment, comprising:

(a) a processor; and (b) a memory in communication with the processor, wherein the memory stores machine instructions that cause the processor to perform the functions of:

(i) determining a vector from the virtual sound source to the virtual listener in the virtual environment, to create a virtual sound source vector;

(ii) determining a vector from the virtual sound source to a virtual speaker position in the virtual environment, to create a virtual speaker position vector, said virtual speaker position being associated with at least one physical sound source, and said virtual speaker position being fixed relative to a location and orientation of the virtual listener such that a location of the virtual speaker position tracks any change in the location of the virtual listener and such that the virtual speaker position tracks any change in the orientation of the virtual listener; and (iii) determining the output to drive the physical sound source as a function of the virtual sound source vector and the virtual speaker position vector; and (iv) driving the physical sound source with the output, thus enabling the physical sound source to simulate an audible experience of the virtual listener exposed to sound from the virtual sound source in the virtual environment.

17. The system of claim 16, wherein the output comprises a sound amplitude.

18. The system of claim 16, wherein the physical sound source comprises a speaker.

19. The system of claim 16, wherein if there is movement between the virtual sound source and the virtual listener, the machine instructions further cause the processor to modify the output to simulate an effect of the movement on an amplitude of the output heard by the virtual listener.

20. The system of claim 16, wherein the machine instructions further cause the processor to perform the functions of:

(a) determining a second virtual speaker position vector between the virtual sound source and a second virtual speaker; and (b) determining the output to drive the physical sound source as a function of the virtual sound source vector, the second virtual speaker position vector, and the virtual speaker position vector.

21. The system of claim 16, wherein the virtual listener comprises a character in the virtual environment.

22. The system of claim 16, wherein the virtual speaker position comprises a predefined location of a virtual speaker relative to the virtual listener.

23. The system of claim 16, wherein the machine instructions further cause the processor to perform the functions of:

(a) normalizing the virtual sound source vector relative to a unit sphere in the virtual environment, wherein the unit sphere remains centered on the virtual listener relative to any change in a disposition of the virtual listener in the virtual environment, and wherein the virtual speaker is disposed on the unit sphere; and (b) normalizing the virtual speaker position vector relative to the unit sphere.

24. The system of claim 16, wherein the function is one of a linear and a nonlinear function.

25. The system of claim 17, wherein the machine instructions further cause the processor to perform at least one of the functions of:

(a) adjusting the output as a function of a distance shift between the virtual sound source and the virtual listener; and (b) adjusting the output as a function of a Doppler effect.

26. The system of claim 16, wherein the machine instructions further cause the processor to perform the functions of:

(a) determining an orientation of the virtual listener; and (b) changing the virtual speaker position in the virtual environment as a function of a change in the orientation of the virtual listener in the virtual environment.

27. The system of claim 16, wherein the machine instructions further cause the processor to perform the function of applying a transformation to the virtual speaker position in relation to a change in one of the position and the orientation of the virtual listener in the virtual environment.

28. The system of claim 16, wherein the machine instructions further cause the processor to perform the functions of:

(a) determining a second virtual speaker position vector from the virtual sound source to a second virtual speaker position in the virtual environment, said second virtual speaker position being associated with a second physical sound source, and said second virtual speaker position being fixed relative to the location and orientation of the virtual listener such that a location of the second virtual speaker position tracks any change in the location and the orientation of the virtual listener; and (b) determining a second output to drive the second physical sound source as a function of the virtual sound source vector and the second virtual speaker position vector.

29. The system of claim 16, wherein the machine instructions further cause the processor to perform the functions of:

(a) determining a plurality of additional virtual speaker position vectors from the virtual sound source to each of a plurality of additional virtual speaker positions in the virtual environment, each of said additional virtual speaker positions being associated with a corresponding different additional physical sound source, and said plurality of additional virtual speaker positions being fixed relative to the location and orientation of the virtual listener such that locations for each of the plurality of additional virtual speaker positions track any change in the location and the orientation of the virtual listener; and (b) determining the output to drive each additional physical sound source as a function of the virtual sound source vector, the virtual speaker position vector, and a corresponding one of the plurality of additional virtual speaker position vectors.

30. The system of claim 16, wherein the processor is a secondary processor.

31. A method for attenuating an output to drive a physical sound device, wherein the output indicates a spatial position of a virtual sound source that produces a simulated sound in a simulation, comprising the steps of:

(a) defining a unit sphere in the simulation, wherein the unit sphere remains centered on a virtual listener relative to a location of the virtual listener in the simulation and wherein an orientation of the unit sphere remains fixed relative to an orientation of the virtual listener;

(b) enabling a user to specify a location on the unit sphere of a virtual device, said location of the virtual device remaining fixed on the unit sphere relative to the location of the virtual listener and relative to the orientation of the unit sphere;

(c) determining a distance from the virtual listener to the virtual sound source in the simulation, to produce a virtual sound source distance;

(d) determining a normalized location on the unit sphere of the virtual sound source as a function of the virtual sound source distance;

(e) determining a distance from the location on the unit sphere of the virtual device to the normalized location on the unit sphere of the virtual sound source, to produce a virtual device distance;

(f) determining an attenuation factor as a function of the virtual device distance; and (g) applying the attenuation factor to the simulated sound of the virtual sound source to attenuate a magnitude of the simulated sound that produces the output to drive the physical sound device.

32. The method of claim 31, wherein:

(a) the output comprises a signal amplitude; and (b) the physical sound device comprises a speaker.

33. The method of claim 31, wherein the simulation comprises an electronic game.

34. The method of claim 31, wherein the virtual listener comprises a character in the simulation.

35. The method of claim 31, further comprising the steps of:

(a) changing at least one of the location and the orientation of the virtual listener relative to the virtual sound source, to produce an updated virtual listener position;

(b) changing the location and the orientation of the virtual sound device by an amount equivalent to the corresponding change of the at least one of the location and the orientation of the virtual listener;

(c) determining a distance between the updated virtual listener position to the virtual sound source in the simulation, to produce an updated virtual sound source distance;

(d) determining an updated normalized location on the unit sphere of the virtual sound source as a function of the updated virtual sound source distance;

(e) determining a distance from the location on the unit sphere of the virtual sound device to the updated normalized location on the unit sphere of the virtual sound source, to produce an updated virtual device distance;

(f) changing the attenuation factor as a function of the updated virtual device distance, to produce an updated attenuation factor; and (g) applying the updated attenuation factor to the simulated sound of the virtual sound source to attenuate the magnitude of the simulated sound and produce an updated output to drive the physical device.

36. The method of claim 31, wherein the steps comprise machine readable instructions stored on a machine readable medium.

37. A system for attenuating an output to drive a physical sound device, wherein the output indicates a spatial position of a virtual sound source that produces a simulated sound in a simulation, comprising:

(a) a processor; and (b) a memory in communication with the processor, wherein the memory stores machine instructions that cause the processor to perform the functions of:

(i) defining a unit sphere in the simulation, wherein the unit sphere remains centered on a virtual listener relative to a location of the virtual listener in the simulation and wherein an orientation of the unit sphere remains fixed relative to an orientation of the virtual listener;

(ii) specifying a location on the unit sphere of a virtual device, said location of the virtual device remaining fixed on the unit sphere relative to the location of the virtual listener and relative to the orientation of the unit sphere;

(iii) determining a distance from the virtual listener to the virtual sound source in the simulation, to produce a virtual sound source distance;

(iv) determining a normalized location on the unit sphere of the virtual sound source as a function of the virtual sound source distance;

(v) determining a distance from the location on the unit sphere of the virtual device to the normalized location on the unit sphere of the virtual sound source, to produce a virtual device distance;

(vi) determining an attenuation factor as a function of the virtual device distance; and (vii) applying the attenuation factor to the simulated sound of the virtual sound source to attenuate a magnitude of the simulated sound that produces the output to drive the physical sound device.

38. The system of claim 37, wherein:

(a) the output comprises a signal amplitude; and (b) the physical sound device comprises a speaker.

39. The system of claim 37, wherein the simulation comprises an electronic game.

40. The system of claim 37, wherein the virtual listener comprises a character in the simulation.

41. The system of claim 37, wherein the machine instructions further cause the processor to perform the functions of:

(a) changing at least one of the location and the orientation of the virtual listener relative to the virtual sound source, to produce an updated virtual listener position;

(b) changing the location and the orientation of the virtual sound device by an amount equivalent to the corresponding change of the at least one of the location and the orientation of the virtual listener;

(c) determining a distance between the updated virtual listener position to the virtual sound source in the simulation, to produce an updated virtual sound source distance;

(d) determining an updated normalized location on the unit sphere of the virtual sound source as a function of the updated virtual sound source distance;

(e) determining a distance from the location on the unit sphere of the virtual sound device to the updated normalized location on the unit sphere of the virtual sound source, to produce an updated virtual device distance;

(f) changing the attenuation factor as a function of the updated virtual device distance, to produce an updated attenuation factor; and (g) applying the updated attenuation factor to the simulated sound of the virtual sound source to attenuate the magnitude of the simulated sound and produce an updated output to drive the physical device.

* * * * *